US007044825B2

(12) United States Patent
Glickman et al.

(10) Patent No.: US 7,044,825 B2
(45) Date of Patent: May 16, 2006

(54) PANEL AND GIRDER SYSTEM FOR CONSTRUCTION TOY

(75) Inventors: Joel I. Glickman, Jupiter, FL (US); Alfred Neubauer, Chalfont, PA (US); Charles J. Rodgers, Langhorne, PA (US)

(73) Assignee: Connector Set Limited Partnership, Hatfield, PA (US)

( * ) Notice: Subject to any disclaimer, the term of this patent is extended or adjusted under 35 U.S.C. 154(b) by 80 days.

(21) Appl. No.: 10/900,991

(22) Filed: Jul. 27, 2004

(65) Prior Publication Data

US 2006/0025035 A1 Feb. 2, 2006

(51) Int. Cl.
*A63H 33/08* (2006.01)

(52) U.S. Cl. ..... 446/121; 446/127; 446/126

(58) Field of Classification Search ..... 446/85, 446/124, 121, 126, 127; 52/656.9, 653.1; 403/253, 263, 361, 381
See application file for complete search history.

(56) References Cited

U.S. PATENT DOCUMENTS

| | | | | |
|---|---|---|---|---|
| 4,044,497 | A | 8/1977 | Bettens | |
| 5,350,331 | A | 9/1994 | Glickman | |
| D393,417 | S | 4/1998 | Glickman et al. | |
| 5,918,999 | A * | 7/1999 | Lamarca | 403/397 |
| 5,924,906 | A | 7/1999 | Grafton | |
| 5,947,787 | A | 9/1999 | Cyrus et al. | |
| 5,975,977 | A | 11/1999 | Choi | |
| 5,984,756 | A | 11/1999 | Krog | |
| 6,030,270 | A | 2/2000 | Krog | |
| 6,554,678 | B1 | 4/2003 | Lavender | |
| 6,648,715 | B1 | 11/2003 | Wiens et al. | |
| 6,672,931 | B1 * | 1/2004 | Bagley | 446/106 |
| 6,676,474 | B1 * | 1/2004 | Glickman | 446/126 |

FOREIGN PATENT DOCUMENTS

| | | |
|---|---|---|
| DE | 3802738 | 8/1989 |
| EP | 0711585 | 5/1996 |
| EP | 1068886 | 1/2001 |

* cited by examiner

*Primary Examiner*—Eugene Kim
*Assistant Examiner*—Urszula M Cegielnik
(74) *Attorney, Agent, or Firm*—Schweitzer Cornman Gross & Bondell LLP

(57) ABSTRACT

A construction toy system comprised of a plurality of molded plastic girders and connectors. The girder elements of generally square cross section, with interlocking elements extending axially from each end. The interlocking elements each comprise a flange of square configuration, a groove structure of squared configuration adjacent the flange, and a generally cylindrical rod-like extension projecting between the end of the girder body and the groove structure. Connector elements are formed with one or more sockets for receiving interlocking elements of the girders. The sockets have one open side into which the interlocking elements can be inserted with a lateral snap-in action. The flange portions are freely received in a slot formed in the socket, and the groove structure engages and cooperates with opposed locking ribs formed on the sidewalls of the connector socket. Opposed axial grooves in the socket sidewalls engage opposite side portions of the rod-like extension with a snap-in locking action. At least certain of the girder elements include positioning and retaining elements for mounting of wall panels as part of an overall structure formed with girders and connectors. The above described elements are compatible with existing K'NEX construction toy sets utilizing rods instead of girders, enabling hybrid structures to be formed with combinations of girders and rods, for example.

18 Claims, 9 Drawing Sheets

PANEL AND GIRDER SYSTEM FOR CONSTRUCTION TOY

BACKGROUND OF THE INVENTION

Construction toys are popular with young children, providing various structural elements capable of being assembled by the user in various combinations, either according to provided plans or on a free form basis of the user's own concepts. One of the well known and popular construction toy systems, marketed by K'NEX Industries, Inc. is the "K'NEX®" product, which is described and claimed in a number of U.S. patents, among them U.S. Pat. Nos. 5,061,219, 5,137,486, 5,199,919, 5,350,331, the disclosures of which are incorporated herein by reference.

The construction toy system disclosed in the foregoing U.S. patents comprises an arrangement of rods and connectors, in which the rods can be assembled with the connector sockets with a lateral, snap-in motion. Once assembled with a connector, a rod is held against axial separation by means of an annular groove in the rod which cooperates with opposed rib-like projections in the connector socket. The end of the rod also has a cylindrical portion which cooperates with axially oriented grooves formed in opposite sidewalls of the connector socket, at the open end portion of the socket. Following the snap-in assembly of the rod, the cylindrical end portion of the rod is held snugly within the axial grooves of the socket to maintain the rod firmly up in the grip of the socket. The described system enables strong and complex structures to be assembled and accommodates an extraordinarily wide variety of structural arrangements with both static and dynamic features.

SUMMARY OF THE INVENTION

Whereas in the presently commercialized form of the K'NEX product, a principal structural component is in rod form, it is desired to provide an expanded range of construction possibilities, utilizing girder-like elements which can more realistically simulate the girder and panel construction of real buildings. Girder-based construction toy systems are in general known, and a notable example of such is the Bettens U.S. Pat. No. 4,044,497. The present invention is directed to a girder and panel construction of the general type shown in the Bettens '497 patent, but incorporating significant improvements in the design and construction of both the girders and the connecting means to provide a more useful and more versatile construction system.

In accordance with one of the objectives of the invention, a panel and girder construction toy system is provided which is arranged to incorporate certain of the significantly advantageous features of the existing K'NEX rod and connector system and to adapt them in a unique manner for effective use in a panel and girder construction system. Additionally, an additional objective of the invention is the providing of a panel and girder construction toy system in which the girder and connector elements may, in appropriate circumstances, be interchanged with elements of the existing rod and connector systems, to enable hybrid structures to be formed.

In a girder and panel construction toy system, the girder-like structural elements preferably have a geometrical cross section such that proper rotational orientation of the girder element in relation to its longitudinal axis is highly desirable and customarily is provided for. In the system of the present invention, a simplified yet effective arrangement is provided for proper rotational orientation of the girders in their respective connectors, while at the same time accommodating the possibility of hybrid structures, in which one or more rod elements may be installed. With respect to such rod elements, a predetermined rotational orientation typically is neither necessary nor desired.

In the system according to the present invention, provision is made for a simple snap-in installation of wall panels, after assembly of a skeletal structure consisting of girders and connectors. Typically, the girder and connector assemblies frame a rectangular opening in which a flat panel, which can be transparent to simulate a window panel or opaque to simulate a closed wall, can be snap-fitted in place.

For a more complete understanding of the above and other features and advantages of the invention, reference should be made to the following detailed description of preferred embodiments thereof, and also to the accompanying drawings.

DESCRIPTION OF A PREFERRED EMBODIMENT

Figure 1:
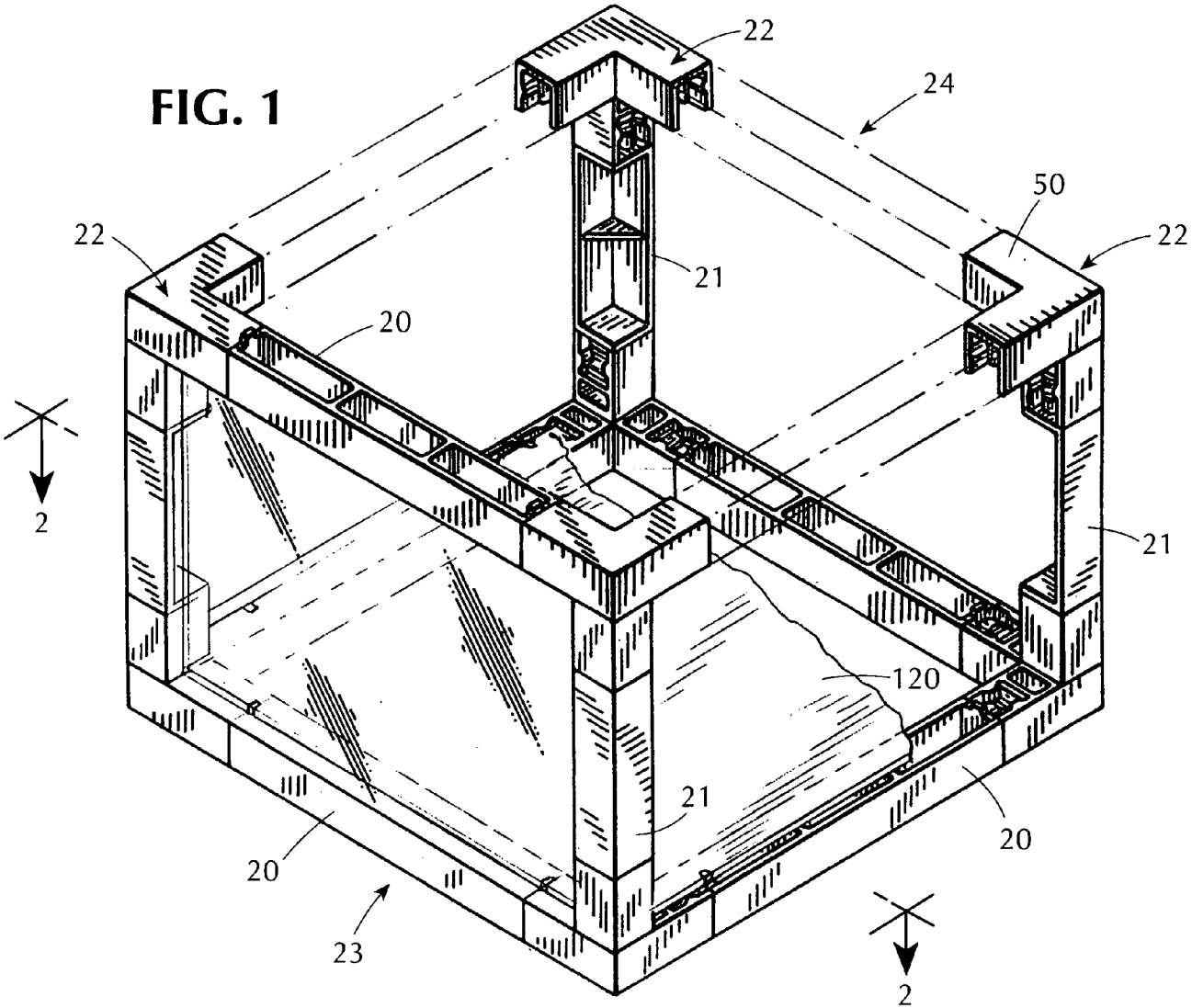
FIG. 1 is a perspective view, with parts broken away, of a simple structure formed with the panel and girder system of the invention.

Referring now to the drawings, and initially to FIG. 1, there is shown a structure which is comprised of a plurality of girder elements 20, 21 joined by corner connector assemblies 22 to form a simple box-like structure. The structure shown in FIG. 1 comprises a lower tier 23 and an upper tier 24 connected by the girder elements 21 which extend vertically at the respective corners of the structure.

Figure 7:
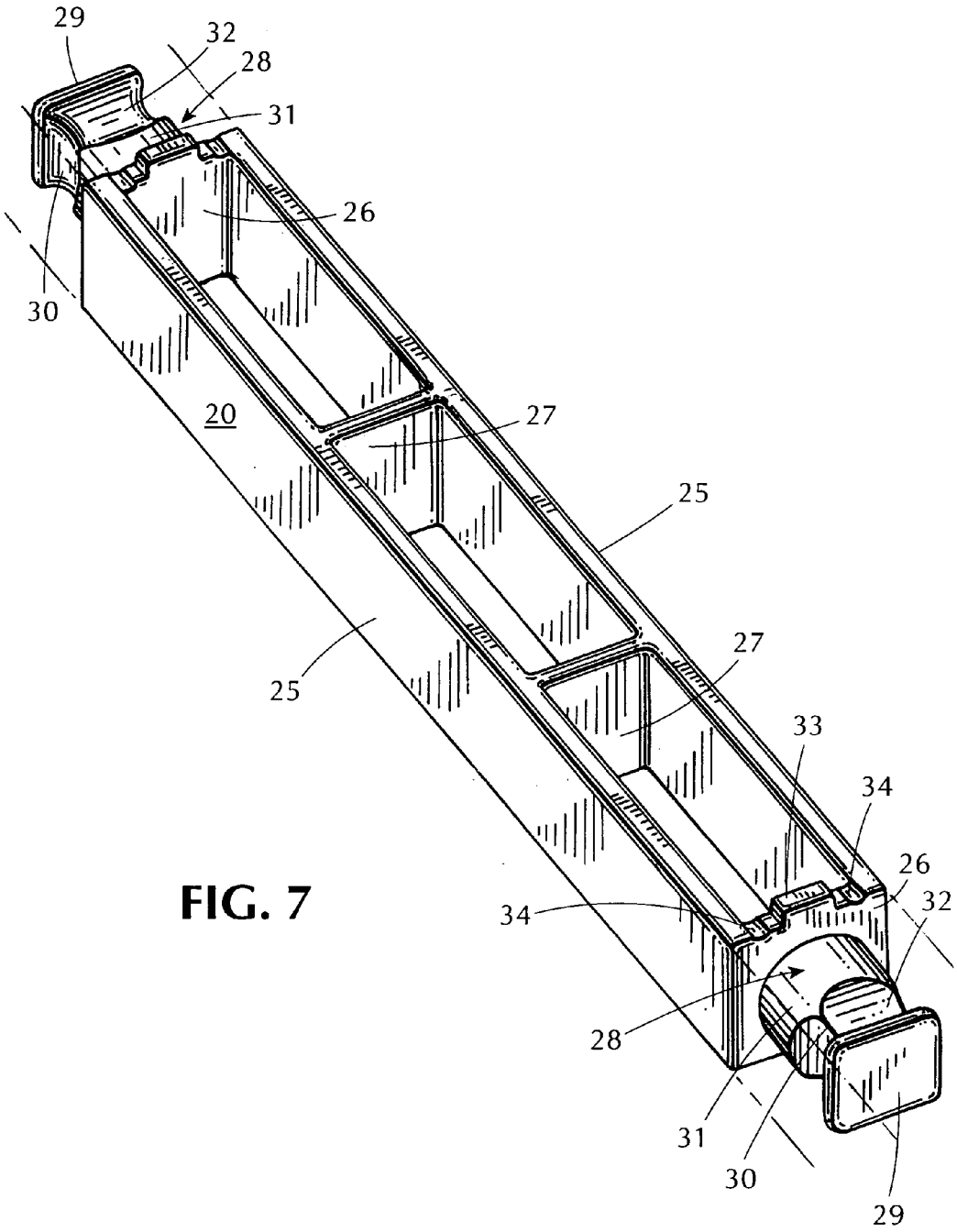
FIG. 7 is a perspective view of a typical girder element forming part of the new construction toy system.

The horizontal girder elements 20 are shown in greater detail in FIG. 7 and comprise spaced-apart sidewalls 25 rigidly joined by opposite end walls 26 and intermediate partition walls 27. The main body of the girder, which comprises the walls 25, 26 and partitions 27 preferably has a square cross sectional outline which, by way of illustration but not limitation, may be approximately 0.372 inch on a side for a typical children's construction toy set. The girder elements 20 may be provided in a variety of lengths, as desired.

Interlocking elements 28 are provided at each end of the body of the girder, integral with the end walls 26 thereof and projecting axially outward therefrom. Pursuant to the invention, each of the interlocking elements comprises an end flange 29, a groove structure 30 immediately adjacent to the end flange 29, and a rod-like extension 31 which joins the groove structure 30 with the end wall 26. For purposes to be described in greater detail, the end flange 29 preferably has a square configuration which, for purposes of illustration and not limitation, may be approximately 0.246 inch on a side. The rod-like extension 31 preferably is of circular cross section and of a diameter equal to the lateral dimensions of the square end flange 29. The groove structure 30 consists of four groove sections 32 formed on axes parallel to the side edges of the end flanges 29, as is evident from the illustration of FIG. 7. Also evident in FIG. 7 is the fact that the side edges of the end flanges 29 are oriented to correspond with the square cross section of the body of the girder 20.

In the illustrated form of the girder element 20, shown in FIG. 7, the opposite sidewalls 25 typically will be oriented vertically in a structural assembly, and will define vertical openings between the end walls 26 and partitions 27. To advantage, short vertical tabs 33 project upward and downward from the otherwise square cross sectional outline of the end walls 26 and provide locating tabs for positioning floor panels, for example. In an illustrative case, the tabs 33 may project about 0.037 inch from the primary edge surface of the end wall 26. In addition, small detent grooves 34 are provided in the end walls 26, on opposite sides of the locating tabs 33. These serve, as will be more fully described, as locating and mounting means for wall panels which can be incorporated in a structural assembly.

The girder element 20, as well as the girder element 21 to be described, advantageously are formed by injection molding of a suitable engineering plastic material, such as ABS.

Figure 11:
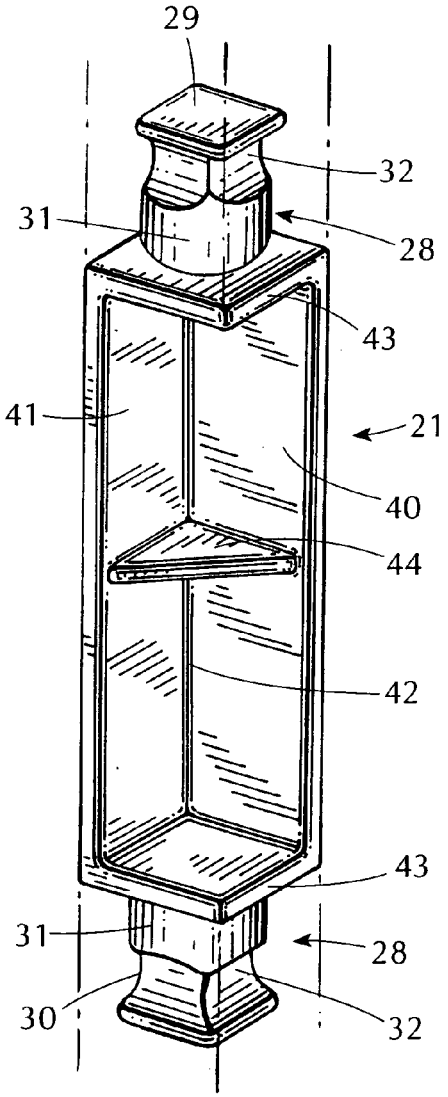
FIG. 11 is a perspective view of a modified form of girder element having two adjacent sidewalls and two open sides.

In the illustrated form of the invention, the vertically oriented girders 21 preferably are designed for installation at vertical corners of a structure, as shown in FIG. 1. These corner girders, shown in more detail in FIG. 11, comprise sidewalls 40, 41 joined along a common side edge 42 to form a right angle corner. End walls 43 are located at each end, and a triangular supporting partition 44 is located at an intermediate position along the length of the sidewalls. The end walls 43 are of square outline, and define a square envelope for the girder 21. Interlocking elements 28, which in all respects correspond to the interlocking elements 28 of the girder 20, project axially outward from the end wall panels 43. Individual portions of the interlocking elements 28 of the girder 21 are assigned the same reference numerals as the corresponding portions of the interlocking elements 28 of the girder 20 shown in FIG. 7.

Figure 2:
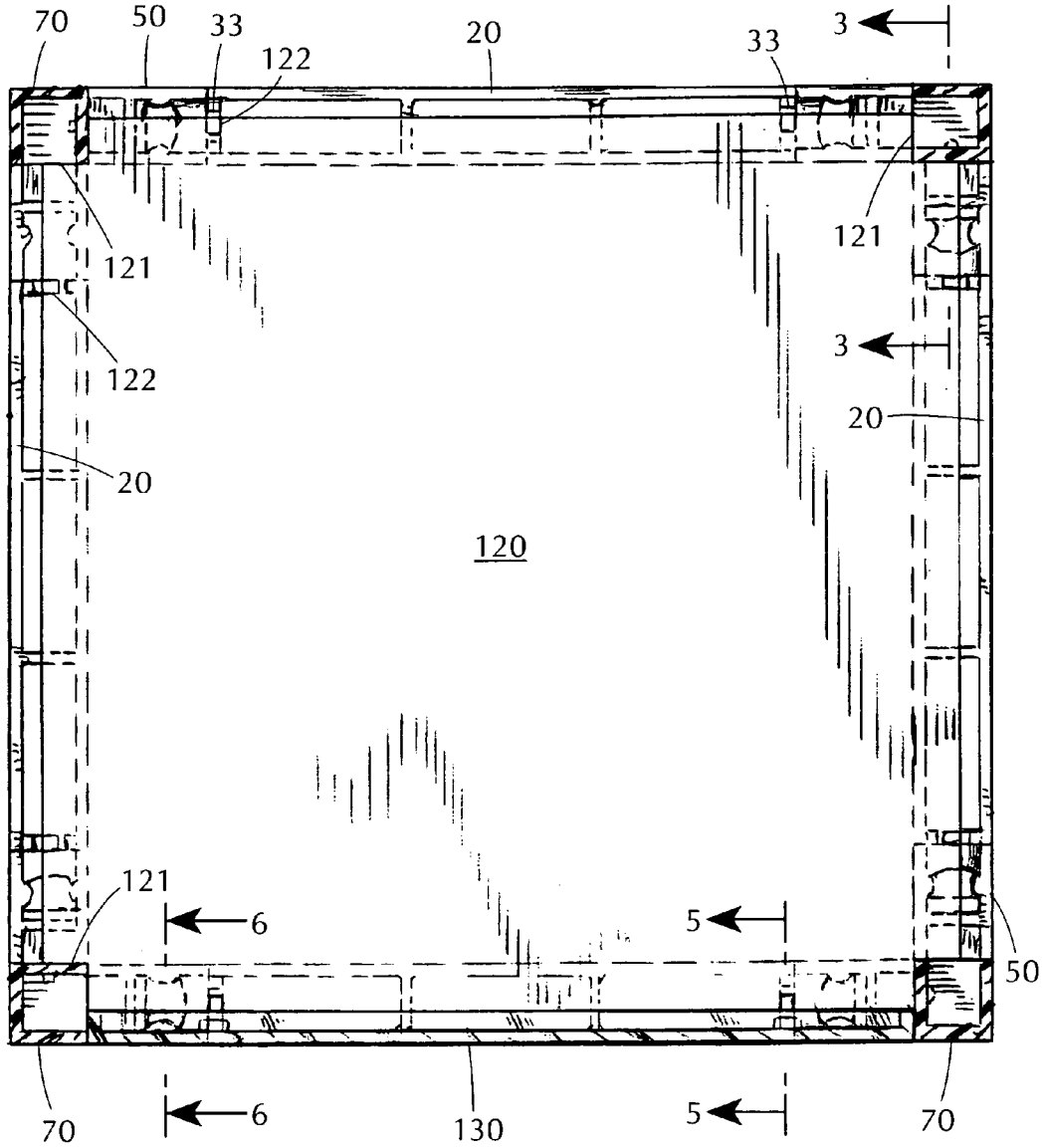
FIG. 2 is a cross sectional view as taken generally on line 2–2 of FIG. 1.

The assembled structure shown in FIGS. 1 and 2 is comprised of a plurality of the horizontal and vertical girders 20, 21 joined by various connector elements described below.

Figure 3:
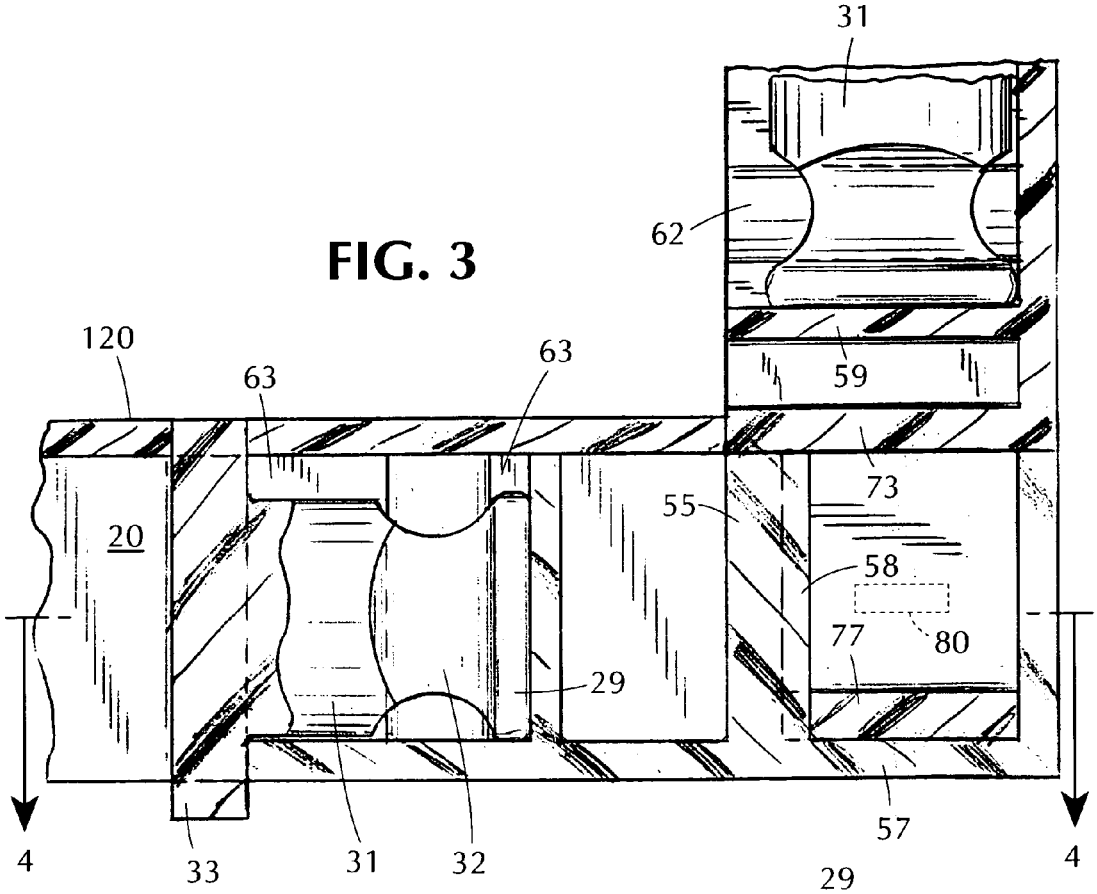
FIG. 3 is an enlarged, fragmentary cross sectional view as taken generally on line 3–3 of FIG. 2.
Figure 4:
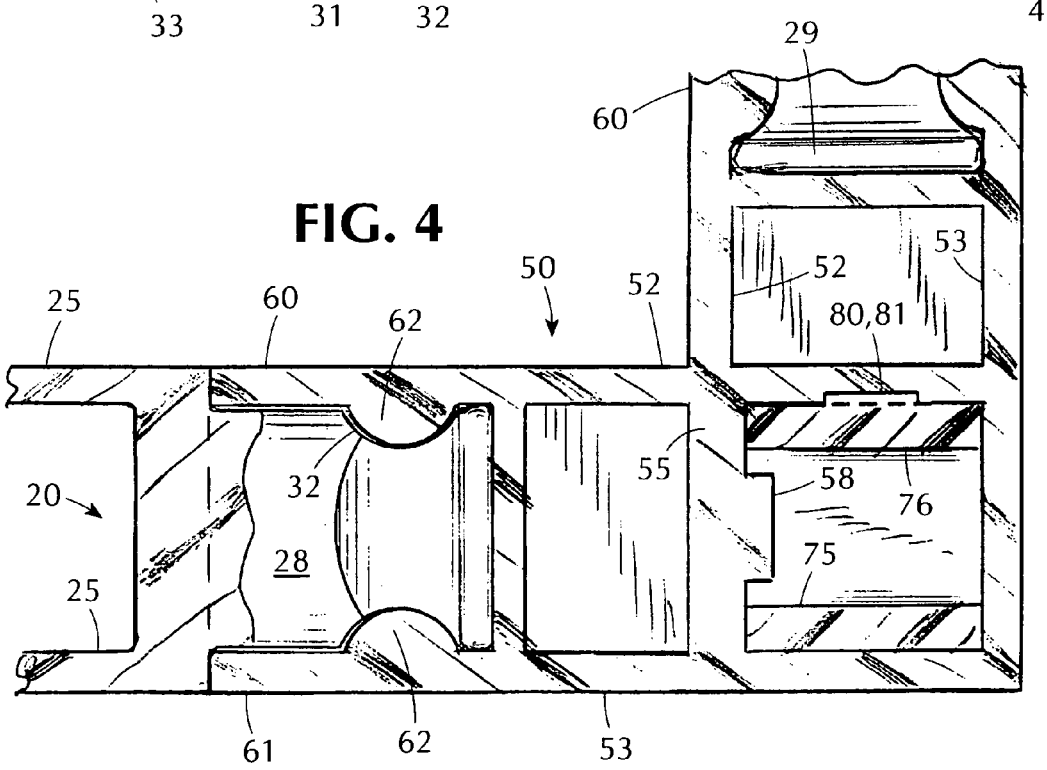
FIG. 4 is an enlarged, cross sectional view as taken generally on line 4–4 of FIG. 3.
Figure 9:
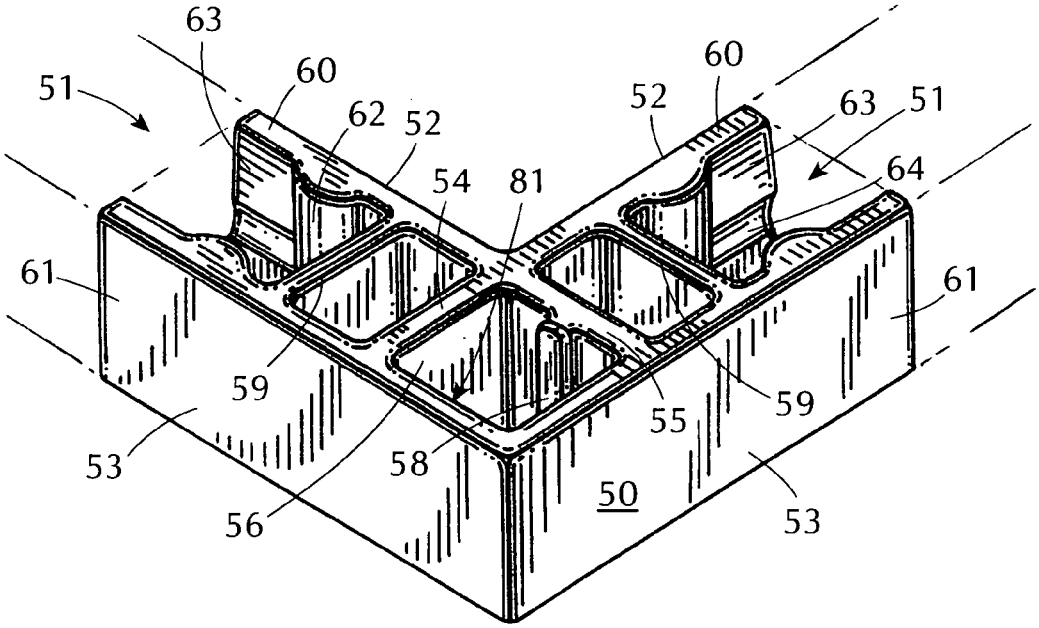
FIG. 9 is a perspective view of a second form of connector element forming part of the new system and adapted to be joined with the element of FIG. 8.

With reference to FIG. 9, there is shown a right angle connector 50, details of which are also shown in FIGS. 3 and 4. Each connector comprises a pair of sockets 51 which are oriented in a common plane but at right angles to each other. The connector is formed with inner and outer sidewalls 52, 53. Partition walls 54, 55, which in effect form extensions of the inner sidewalls 52, form a square recess 56 closed by a bottom wall 57 (FIG. 3). The recess 56, which is open at one side (the top side as the part is oriented in FIG. 9) advantageously is provided with a vertically extending orienting key 58 projecting into the recess 56 from the wall 55. The purpose of the recess 56 and key 58 will be described later on. The respective sockets 51 are spaced outward from the corner recess 56 and are defined by end walls 59 and outer portions 60, 61 of the respective sidewalls 52, 53. In the illustrated and preferred form of the invention, the bottom wall 57 (FIG. 3) extends for the full length of the sidewalls 52, 53, and thus forms a bottom wall for the sockets 51, which are thus open only on one side.

Opposed locking ribs 62 extend vertically in the sockets 51, spaced a short distance outward from the socket end walls 59. Preferably, the locking ribs 62 may be formed on a radius of about 0.088 inch and may project a short distance, for example, approximately 0.024 inch inward from the socket sidewalls 60, 61. The center axes of the locking ribs 62 advantageously are spaced outward a distance of about 0.12 inch from the outer face of the socket end wall 59. As reflected particularly in FIGS. 3 and 4, for example, this defines a vertically opening pocket 63 for the slide-in reception of the end flange 29 of a girder element 20, 21. When a girder element is thus positioned in a socket 51, an opposed pair of groove sections 32 receive the opposed locking ribs 62. In the illustrated arrangement, both the end flanges 29 and the groove sections 32 are of square configuration and thus rotationally orient the girder 20 such that its sidewalls 25 are aligned in a desired manner with the sidewalls 52, 53 of the connector element.

In accordance with one aspect of the invention, the spacing between the outer portions of the socket walls 60, 61 is slightly less than the diameter of the rod-like extension 31 of the interlocking elements 28. To enable the rod-like extensions to be inserted into the socket, the "upper" portions of the socket walls 60, 61 are upwardly divergently tapered in the areas 63. In addition, the socket walls 60, 61 are provided with axially disposed grooves 64, which are positioned to receive opposite side portions of the rod-like extension 31. Thus, when a girder element 20, 21 is inserted into a socket 51, the rod-like extension thereof, when entering the socket in a direction lateral to its axis, will first displace the socket sidewalls 60, 61 outward as it moves through the tapered wall sections 63. Thereafter, the rod-like extension will enter the grooves 64 with a snap-in action, and thereafter will remain snugly gripped within the socket, held against all but intentional removal therefrom.

As reflected in FIG. 3, when the interlocking element 28 is seated within the socket, the lower portions of the flange 29 and rod-like extension 31 may be close to or in contact with the upper surface of the bottom wall 57 of the connector. When a girder 20 is assembled with the connector element 50, the outer sidewalls 25 of the girder are aligned and oriented with the outer sidewalls 53 of the connector, as shown in FIG. 1, providing continuous surfaces oriented toward to the outside and inside of the structure shown in FIG. 1.

Figure 8:
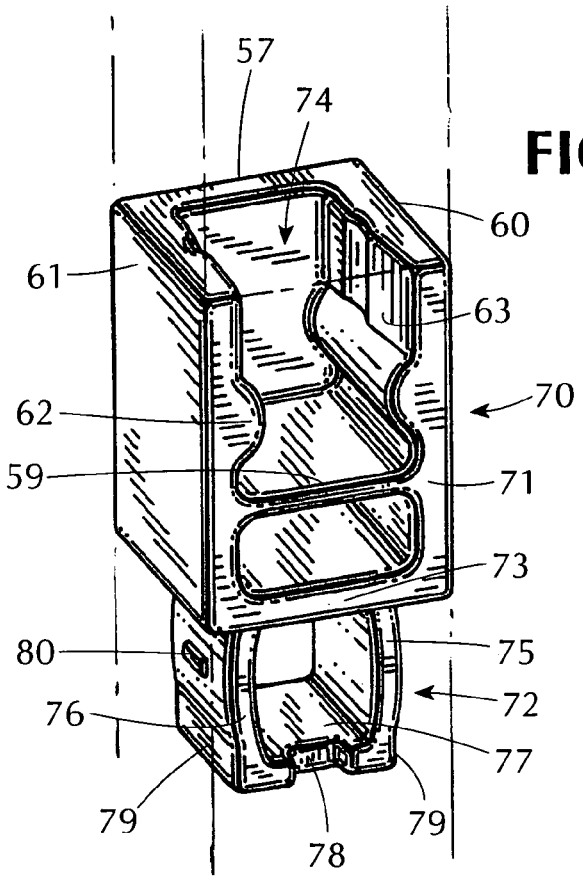
FIG. 8 is a perspective view of one form of connector element used in the new system.

For the construction of three-dimensional structures, it is necessary that connections be available on a three-axis basis. To this end, the connector assemblies 22, as shown in FIG. 1, are comprised of the connector elements 50 (FIG. 9) in combination with separate connector units 70, as shown in FIG. 8. The connector unit 70 is comprised of a body portion 71 and a tongue portion 72 which extends axially from an end wall 73 of the body portion. The body portion is formed with a socket 74 which in all respects corresponds to the previously described sockets 51 of the connectors 50 and its individual elements are designated by the same reference numerals used to designate the individual elements of the sockets 51.

The tongue portion 72 of the connector unit 70 projects downward (in the orientation of FIG. 8) from the end wall 73 and is comprised of a pair of spaced-apart, slightly outwardly bowed sidewalls 75, 76 joined at their outer (lower) ends by an end wall 77. The spacing between outer surfaces of the sidewalls 75, 76, in the regions of maximum outward bowing thereof, is slightly greater than the inner dimensions of the recess 56, while the edge-to-edge dimensions of the sidewalls 75,76 preferably are approximately the same as the internal dimensions of the recess 56.

As shown in FIG. 8, the end wall 77 of the tongue portion 72 is provided with an orienting notch 78 arranged to receive the rib 58 (FIG. 9) such that the connector unit can be inserted into the recess 56 only in one orientation, which will expose wall portions 61 and 57 to the outer corners of a structure as shown in FIG. 1.

Preferably, the lower portions 79 of the bowed walls 75, 76 are so dimensioned as to be received freely within the socket 56, in order to facilitate initial assembly. Thereafter, the connector unit 70 has to be pressed firmly downward into the socket, compressing the sidewalls 72 against the adjacent sidewalls of the recess 56.

To advantage, detent lugs 80 are formed on the respective bowed sidewalls 75, 76, and these are adapted to be received in correspondingly dimensioned detent recesses 81 formed in the recess 56 of the connector 50. Thus, when the connecting unit 70 is inserted fully into the recess, it snaps into place and is retained therein against all but intentional removal. A connector assembly thus formed has socket axes extending along X, Y, and Z axes.

Figure 10:
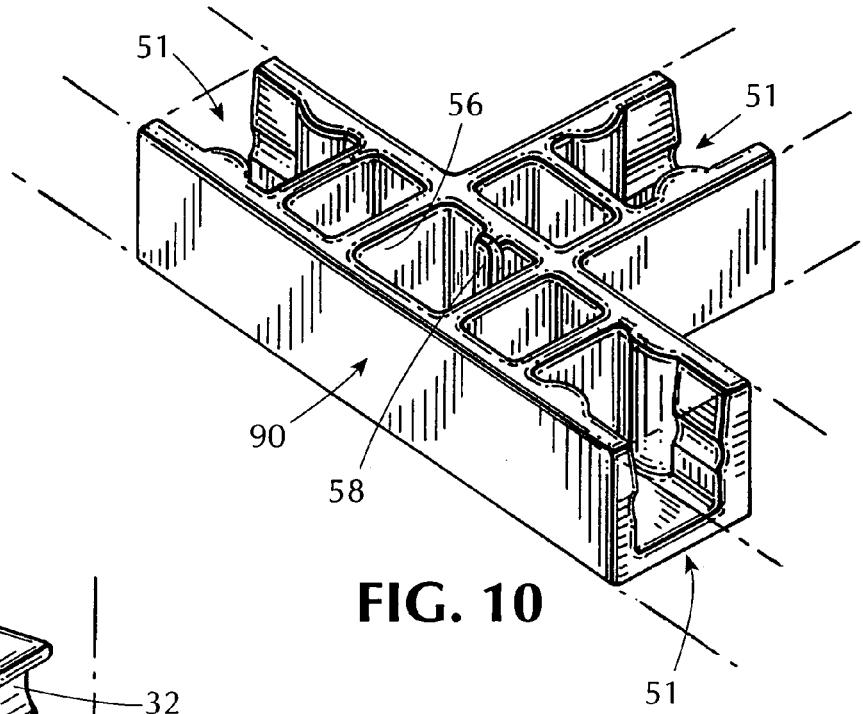
FIG. 10 is a perspective view of a T-shaped connector element of the new system.

With reference to FIG. 10, there is shown a T-shaped connector 90 comprising three socket portions identified by the numerals 51, being in all respects similar to the socket portions 51 of FIG. 9. A recess 56 is located at the intersection of the axis of the several socket portions 51, corresponding to the recess 56 of the connector 50 shown in FIG. 9. In the connector 90 of FIG. 10, the orienting rib 58 formed in the recess 56 is aligned with the "stem" of the T-shaped connector element. In all functional respects, the connector element 90 of FIG. 10 performs in the manner described with respect to the connector 50 of FIG. 9, including its ability to receive the connector 70 of FIG. 8.

Figure 12:
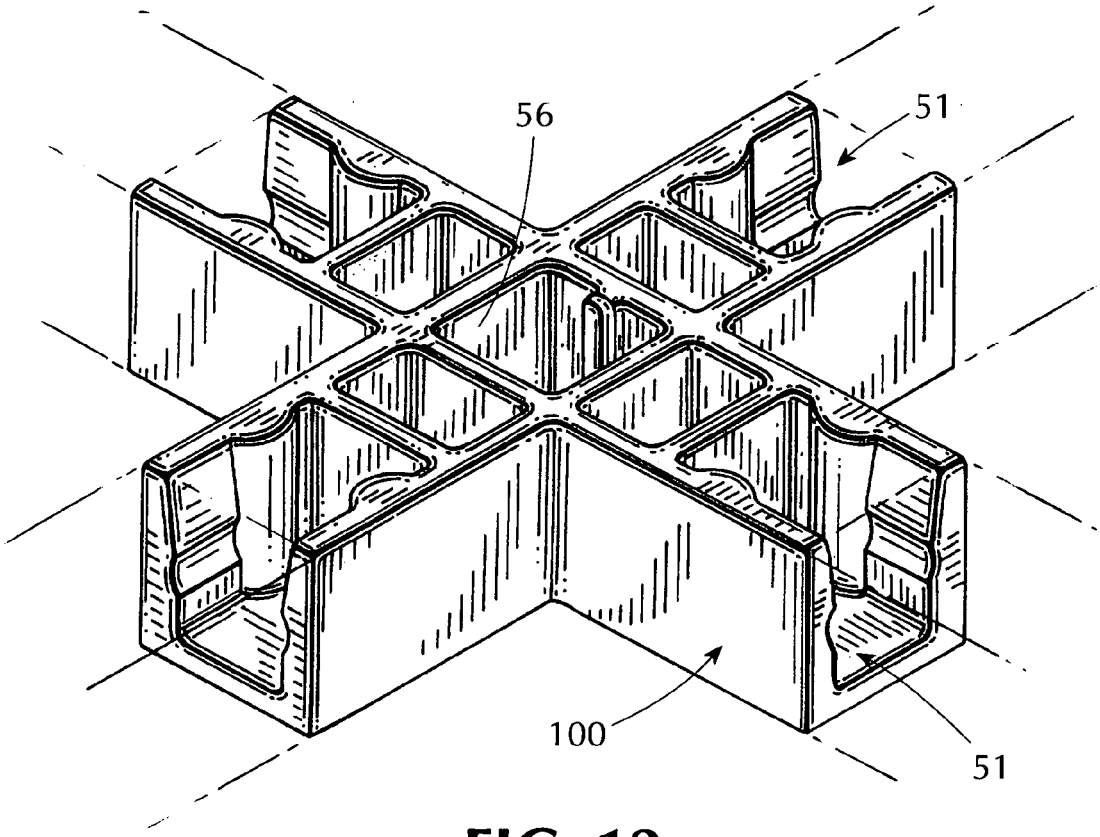
FIG. 12 is a perspective view of a further form of connector element utilized in the new system, having four right angularly related connection sockets.

The connector element 100, shown in FIG. 12, has four socket portions 51 arranged along two intersecting axis, with a recess 56 at the intersection of the two axis. The function of the connector element 100 is the same the connector element of FIGS. 9 and 10, except for the additional connector socket.

Figure 14:
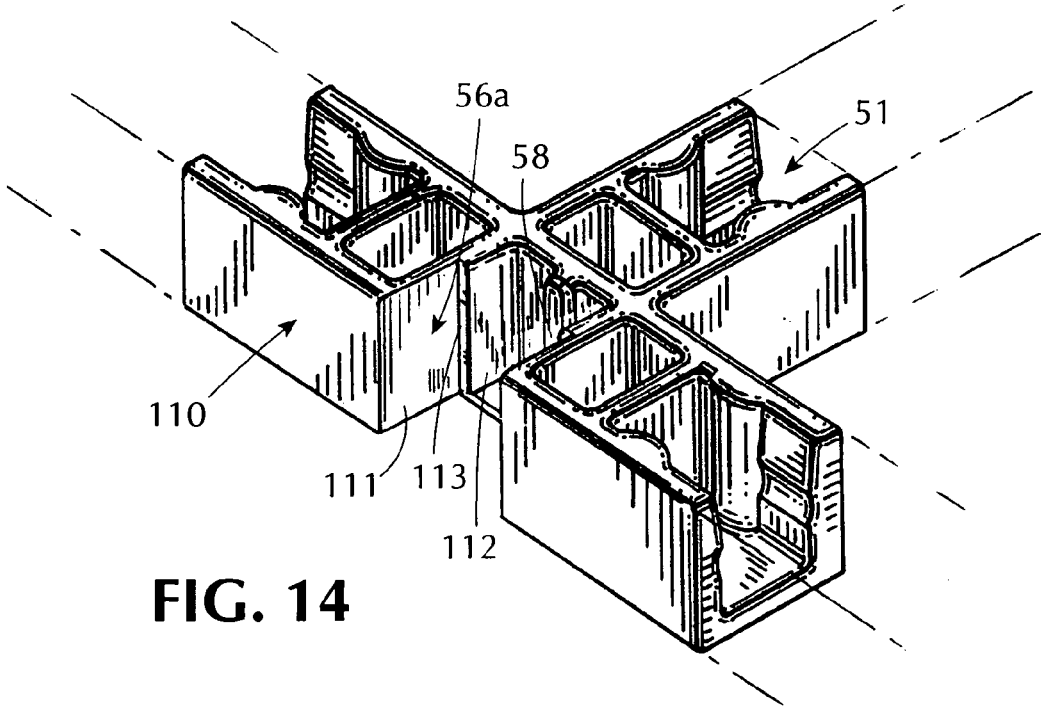
FIG. 14 is a perspective view of yet another alternative form of connector element which can be utilized in the new system.

The connector element 110, shown in FIG. 14; corresponds substantially to the connector element 90 of FIG. 10, except for the configuration of the connector in the region corresponding to the recess 56 of FIG. 10. In the connector 110 of FIG. 14, the recess 56*a* is open on the side opposite the orienting rib 58. Outer side wall portions 111 of the recess 56*a* are spaced apart a distance slightly greater than inner side wall portions 112, as shown in FIG. 14, forming a shoulder 113 where the two side wall portions meet. The spacing between the opposed outer side wall portions 112 is such that two of the connectors 110 may be joined together, with one oriented horizontally and other vertically, with the axes of their respective sockets 51 intersecting at a common point, forming a connector assembly having opposed pairs of sockets 51 oriented along X, Y and Z axes.

The spacing of the outer sidewall portions 111 is also such as to enable it to receive one half of a girder element 20. The arrangement is such that two of the connectors 110, positioned back-to-back, can accommodate the presence of a vertically oriented girder between them. The inner wall portions 112 of the recess 56*a* are of the same width apart as the walls of the recess 56 of the FIG. 10 connector, such that a connector unit 70 (FIG. 8) may be joined with the connector 110 by inserting the tongue portion 72 into the recess 56*a*, capturing one half of the tongue portion 72 between the inner walls 112 of the recess.

All of the various connector elements 50, 70, 90, 100 and 110 described herein preferably are injection molded of a relatively high strength plastic material such as Celcon acetal copolymer, as marketed by Ticona, a division of Celanese.

A structure according to the invention, such as that shown in FIG. 1 of the drawings, can accommodate floor and wall panels in an advantageous manner. In the illustration of FIG. 2, a floor panel 120 is shown installed over and supported by a rectangular configuration of girder elements 20. The floor panel 120 is dimensioned such that its side edges overlap somewhat more than one half of the girder elements positioned underneath and supporting it. At each corner area 121 of the floor panel there is a rectangular cut-out area to accommodate the presence of the vertically extending connector units 70, which extend upward from the lowermost level of right angle connectors 50. The floor panels 120 are provided with two notches 122 along each of their side edges, for the reception of the locating tabs 33 which project upward from the end walls 26 of the underlying girder elements 20. Thus, the panels 120, once installed, are firmly positioned in the structure by the corner notches 121 and by the cooperation between the edge notches 122 and the locating tabs 33. As is evident in FIG. 2, outer edge portions of the girder elements 20 are exposed between the edge extremities of the panel 120 to accommodate the mounting of wall panels.

Figure 5:
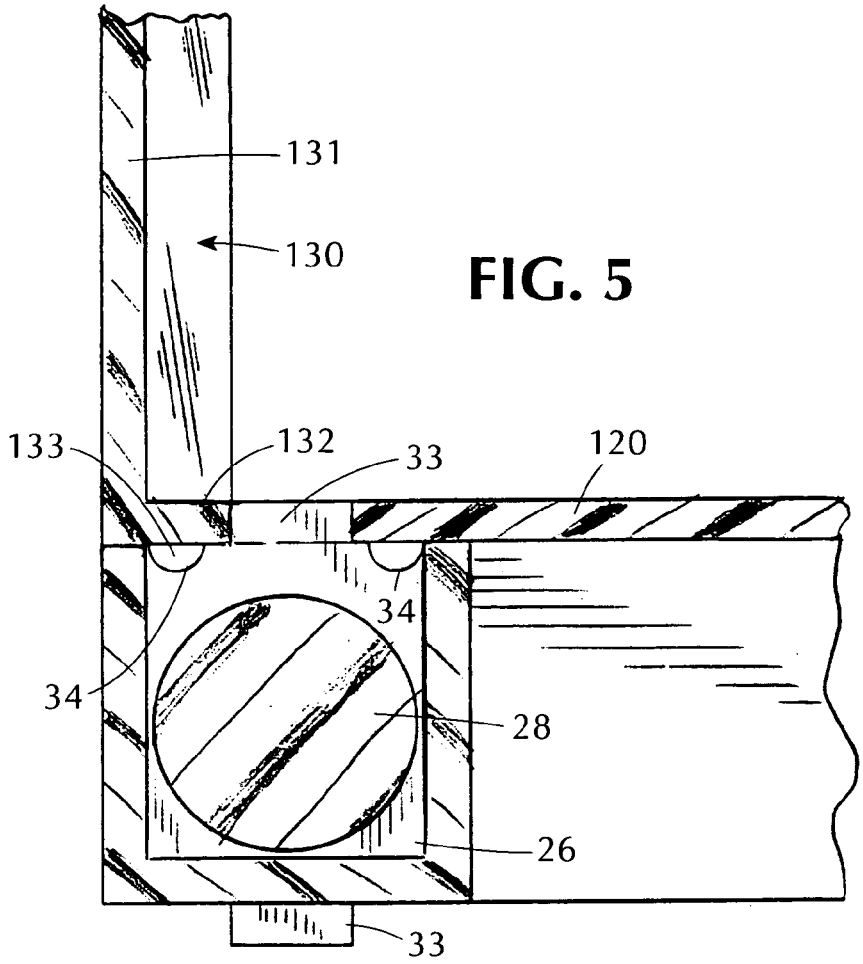
FIGS. 5 and 6 are enlarged, fragmentary cross sectional views as taken generally on lines 5–5 and 6–6 respectively of FIG. 2.
Figure 6:
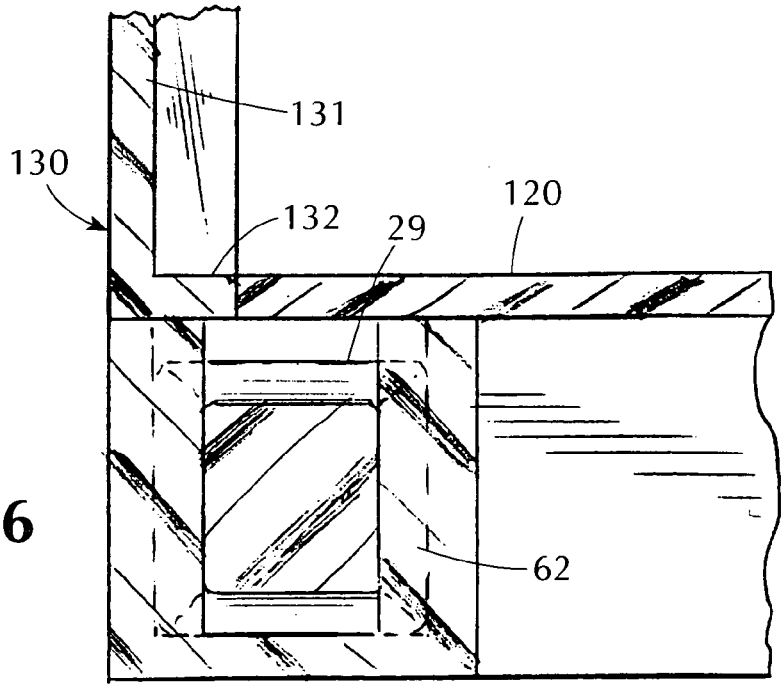
Figure 13:
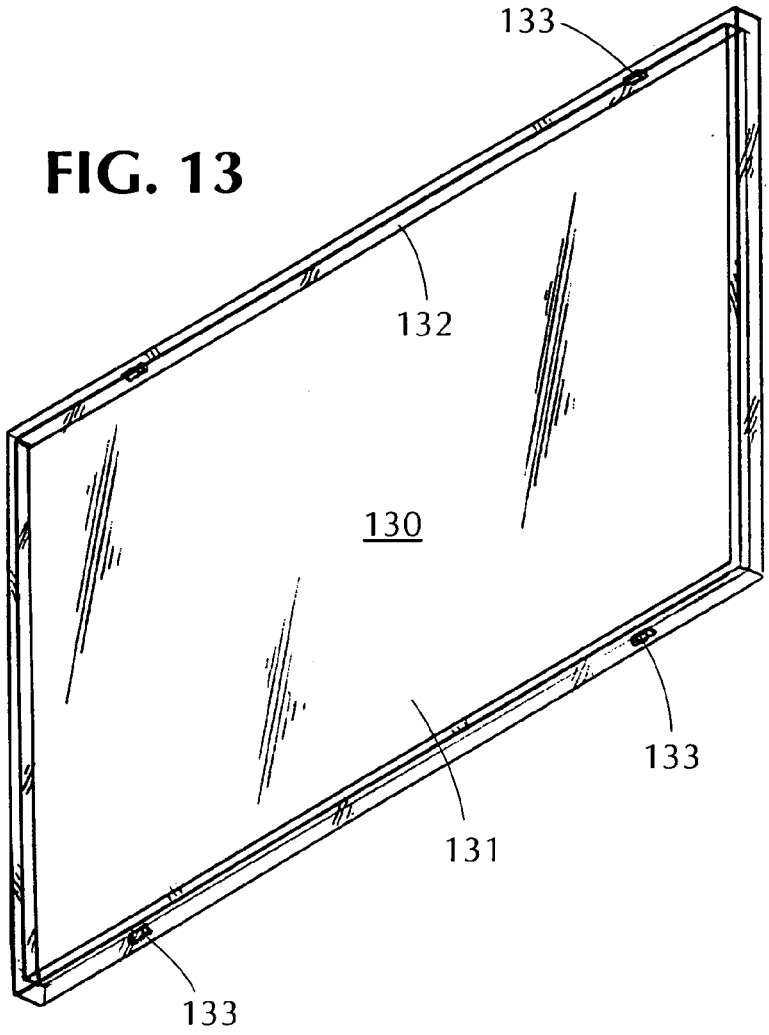
FIG. 13 is a perspective view, looking up from below, of a panel which can be incorporated in a structure of girders and panels.

Referring to FIGS. 5, 6 and 13, there is shown details of a structure utilizing connectors and girders of the present invention, and in which a wall panel 130, of the type shown in FIG. 13, is installed. In the particular embodiment of the invention illustrated herein, an assembly of girders 20 and 21, and connector assemblies 22, as shown in FIG. 1 of the drawing, defines a rectangular opening adapted for the reception of a wall panel. The panel may be opaque, if made of a non-transparent plastic material, or may be formed of clear plastic to serve as a window panel. The panel 130, shown in FIG. 13, comprises a flat center panel portion 131 surrounded by an edge flange 132. The outer dimensions of the edge flange 132 are such as to closely fit within the framed area defined by a spaced pair of vertical girder elements 21 and horizontal girder elements 20, connected together as shown in FIG. 1. The width of the edge flange 132, as shown particularly in FIG. 5, equals the distance from an outer surface of a girder sidewall to the locating projection 33 extending upward from the end wall 26 of the girder. When the wall panel is installed, its outer surface is thus flush with the outer surfaces of the structure illustrated in FIG. 1. Advantageously, the upper and lower extents of the panel edge flange 132 are provided with detent lugs 133 projecting slightly from the outer surfaces of the edge flange and positioned to coincide with the detent recesses 34 of the girder elements 20 (see FIG. 7). When a panel is assembled into a structure of the type shown in FIG. 1, the detent lugs 133 have to be forced slightly over the edges of the girder elements 20, after which they snap into the detent recesses 34 to retain the panels in assembled position for normal usage.

The present disclosure is intended to illustrate the principles of the invention, but not the full scope of its possible application. For example, the girders 20, 21 may be made in a variety of graduated lengths to accommodate structures of different size and shape. The connectors likewise may be constructed in various configurations incorporating the basic inventive principles herein described.

A significant practical advantage of the present invention is that the various components are compatible with the rod and connector elements of the well-known, commercially available K'NEX construction toys. The rod elements of the existing K'NEX sets can be joined with connectors of the type shown herein, to enable various forms of hybrid structures to be developed. Although the flanges 29 and the groove structure 30 of the girder elements 20, 21 are of square configuration, the width dimensions thereof are designed to correspond with the diameters of circular flanges and annular grooves employed in the components of the existing K'NEX sets such that the end portion of standard K'NEX rods may be received in the connectors 50, 70, etc. described herein, while the interlocking elements 28 of the girders can be received in the standard connectors of existing K'NEX sets. Some of the advantageous basic principles of the U.S. patents mentioned at the beginning hereof are adopted in the present structure. Among other things, this enables girder elements to be joined with connectors by a lateral, snap-in movement rather than with an axial insertion movement. This enables very complex structures to be assembled as compared to systems requiring axial insertion of one element with another.

It should be understood, however, that the specific forms of the invention herein illustrated and described are intended to be representative only, as certain changes may be made therein without departing from the clear teachings of the disclosure. Among other things, references herein to specific orientations (e.g., vertical, horizontal, etc.) are referenced to the components in their illustrated orientations, and are not intended to in any way limit the ways in which these components can be oriented in normal usage. Accordingly, reference should be made to the following appended claims in determining the full scope of the invention.

The invention claimed is:

1. A construction toy system comprising a plurality of girders and connectors, characterized by (a) at least certain of said girders being of molded plastic construction and comprising an elongated body portion having a longitudinal axis and an interlocking element on at least one end of said body portion, (b) said body portion being of generally polygonal configuration, (c) said interlocking element extending axially of said body portion and comprising a rod-like extension projecting from an end of said body portion, a neck groove at an outer end of said rod-like extension, and a flange adjacent an outer edge of said neck groove, (d) said rod-like extension having a generally circular cross sectional configuration and at least one of said neck groove and flange having a non-circular cross sectional configuration for effecting rotational orientation of an assembly of a girder and a connector, (e) said flange, in at least one transverse dimension thereof, being of substantially the same dimension as the diameter of said rod-like extension, (f) said connectors being of molded plastic construction and being formed with at least one socket having an open side and an open end, for the lateral snap-in reception of an interlocking element of a girder, (g) said connector socket having an axis and having opposed sidewalls defining axially adjacent regions for the reception of the rod-like extension, neck groove and flange respectively of an interlocking element of a girder, (h) a first of said axially adjacent sidewall regions having an axial dimension generally corresponding to an axial length of a rod-like extension, and an opposed pair of said first sidewall regions being spaced apart such as to snugly grip a rod-like extension between them, (i) said first side wall regions having axially extending grooves therein for snap-in reception of said rod-like extension and thereby resisting lateral separation of said rod-like extension from said connector socket, and (j) at least one of said side walls having in a second region thereof a transversely disposed locking rib projecting into the space between said opposed side walls and positioned to be received within the neck groove of a girder interlocking element inserted laterally into said connector socket, to resist axial separation of said interlocking element from said socket, (k) said socket having a portion spaced from said locking rib and defining a third region of said sidewalls, for the reception of the flange of a girder interlocking element.

2. A construction toy system according to claim 1, wherein, (a) said socket comprises a pair of opposed locking ribs projecting into the space between said opposed side walls, for receiving opposite side portions of said neck groove.

3. A construction toy system according to claim 1, wherein, (a) said flange is of generally square configuration, (b) the said third region of said socket side walls are spaced apart a distance to closely receive opposite side edges of said flange, and (c) said socket has an end wall positioned to closely abut an end face of said flange.

4. A construction toy system according to claim 1, wherein, (a) said neck groove is formed by four generally straight-sided sections, arranged in a generally square configuration, and (b) one of said generally straight-sided sections confronts and engages said locking rib, to resist rotational and axial movement of said girder.

5. A construction toy system according to claim 4, wherein (a) said socket comprises a pair of opposed locking ribs projecting into the space between said opposed side walls, for receiving opposite side portions of said neck groove.

6. A construction toy system according to claim 5, wherein (a) said flange is of generally square configuration, with side edges thereof generally parallel to the strait-sided sections of said neck groove.

7. A construction toy system according to claim 1, wherein (a) portions of said first side wall regions between said axially extending grooves and the open side of said socket are divergently tapered toward said open side to facilitate lateral assembly of an interlocking element into said socket, and (b) the spacing between said first side wall portions, immediately adjacent to said axially extending grooves, is less than the diameter of said rod like extension.

8. A construction toy system according to claim 1, wherein (a) said socket has a bottom wall opposite the open side thereof.

9. A construction toy system according to claim 1, wherein (a) said system includes at least one connector having at least two sockets arranged at right angles, (b) said at least one connector further including a recess adjacent inner ends of said sockets, and (c) said recess is open on one side and has an axis extending from said one side at right angles to a plane defined by said at least two sockets.

10. A construction toy system according to claim 9, wherein (a) said system includes a single socket connector unit comprising a socket for the reception of an interlocking element and having a tongue portion extending from an end thereof opposite an open end of said socket, and (b) said tongue portion is insertable in said recess to form a connector assembly having sockets disposed along X, Y, and Z axes.

11. A construction toy system according to claim 10, wherein (a) the tongue portion of said single socket connector unit comprises spaced apart, outwardly convexly bowed walls engageable with opposed walls of said recess, and (b) said bowed walls are compressed inwardly upon insertion of said tongue into said recess.

12. A construction toy system according to claim 1, wherein (a) said girders have two side walls and two open sides defining said body portion.

13. A construction toy system according to claim 12, wherein (a) said two side walls are parallel and spaced apart, and (b) said side walls are of generally uniform width and are spaced apart a distance such as to form a body portion of substantially square cross sectional configuration.

14. A construction toy system according to claim 12, wherein (a) said two side walls are oriented at right angles and are joined along one edge of each in an L-shaped configuration.

15. A construction toy system according to claim 1, wherein (a) said girders and connectors can be assembled and configured to form a rectangular opening, (b) the system includes a rectangular panel of a size and shape to fit closely in said rectangular opening, and (c) cooperating detent elements on said panel and on at least certain of said girders and connectors enable a snap-in assembly and retention of said panel in said opening.

16. A construction toy system according to claim 15, wherein (a) certain of said girders are formed with locating tabs projecting into said rectangular opening and serving to position said panel.

17. A construction toy system according to claim 16, wherein (a) said girders include first and second side walls and transverse walls joining with said side walls, (b) said locating tabs project from central portions of said transverse walls, and (c) said transverse walls are formed with detent recesses therein for engagement with detent projections on said wall panel.

18. A construction toy system according to claim 1, wherein (a) the system includes at least two connectors having at least three sockets arranged at right angles to each other with respective axes thereof disposed in a common plane, in a generally T-shaped configuration, (b) each of said at least two connectors having an open-sided recess at an intersection of said axes, (c) said open-sided recesses being of a size and shape to enable said at least two connectors to be joined together, with one oriented horizontally and the other oriented vertically, with the axes of both of said connectors substantially intersecting at a common point to form a connector assembly with sockets oriented along X, Y and Z axes.

* * * * *